US005501505A

United States Patent [19]

Jablonski

[11] Patent Number: 5,501,505

[45] Date of Patent: Mar. 26, 1996

[54] SHOULDER STRAPS FOR BEACH CHAIR

[76] Inventor: David Jablonski, 14A Birchview Dr., Piscataway, N.J. 08854

[21] Appl. No.: 301,597

[22] Filed: Sep. 7, 1994

[51] Int. Cl.[6] ..... A47C 1/00

[52] U.S. Cl. ..... 297/4; 224/155; 224/209

[58] Field of Search ..... 297/4, 45, 452.1, 297/485, 17, 129, 16.1, 118, 440.1, 440.11; 224/151, 155, 160, 161, 153, 156, 209, 259, 210; 24/72

[56] References Cited

U.S. PATENT DOCUMENTS

| | | | |
|---|---|---|---|
| 652,352 | 6/1900 | Doell | 224/160 |
| 2,133,717 | 10/1938 | Robes, Jr. | 224/156 X |
| 2,407,714 | 9/1946 | Maloney | 224/209 X |
| 2,461,526 | 2/1949 | Cull rt al. | 224/209 |
| 2,480,402 | 8/1949 | Elston | 224/155 X |
| 2,656,875 | 10/1953 | Hutchinson | 297/4 |
| 2,822,117 | 2/1958 | Mack | 297/4 X |
| 2,967,649 | 1/1961 | Mack | 297/4 |
| 3,266,686 | 8/1966 | Griffith | 224/9 |
| 3,612,605 | 10/1971 | Posey | 297/485 X |
| 3,799,414 | 3/1974 | Fiffer | 224/161 |
| 3,822,422 | 7/1974 | Buntyn | 224/156 X |
| 4,574,990 | 3/1986 | Remis | 224/255 |
| 4,720,029 | 1/1988 | Varanakis | 224/155 |
| 4,762,256 | 8/1988 | Whitaker | 297/4 X |
| 4,903,873 | 2/1990 | Poole et al. | 224/160 |
| 5,016,792 | 5/1991 | Jay | 224/155 |
| 5,087,095 | 2/1992 | McFate | 297/129 |
| 5,139,308 | 8/1992 | Ziman | 297/129 X |
| 5,203,613 | 4/1993 | Ward | 297/485 |
| 5,301,371 | 4/1994 | Chao | 297/464 X |
| 5,318,342 | 6/1994 | Hale | 297/129 |

FOREIGN PATENT DOCUMENTS

| | | | |
|---|---|---|---|
| 960444 | 4/1950 | France | 224/161 |
| 158818 | 3/1905 | Germany | 297/4 |

*Primary Examiner*—Milton Nelson, Jr.
*Attorney, Agent, or Firm*—Joseph H. McGlynn

[57] ABSTRACT

A pair of straps that can be attached to a variety of beach chairs and are designed so that the straps need no adjusting buckles to fit people of different sizes without sliding off their shoulders. The straps are attached, and will hang, behind the chair when the chair is used for sitting. The straps cross over each other in a V-shape or an X-shape and will enable a person to carry the chair on his back, therefore leaving his hands free.

5 Claims, 1 Drawing Sheet

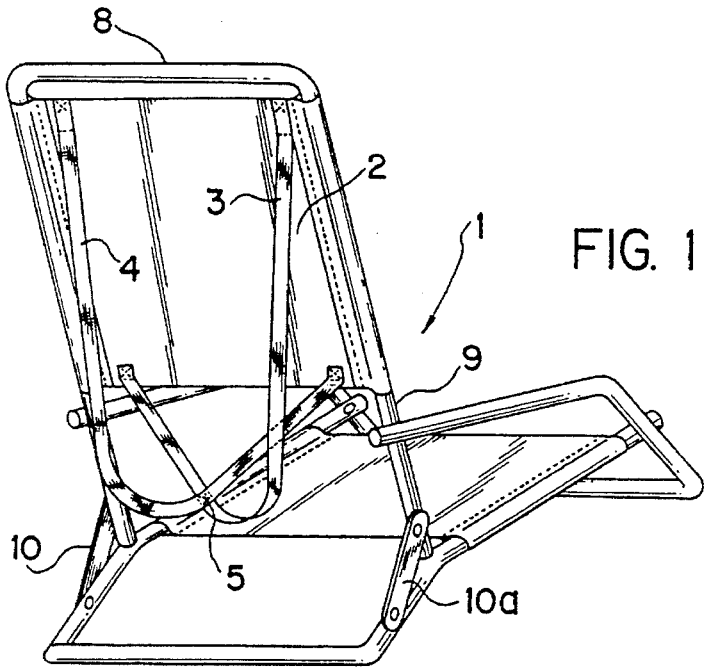
FIG. 1
FIG. 2
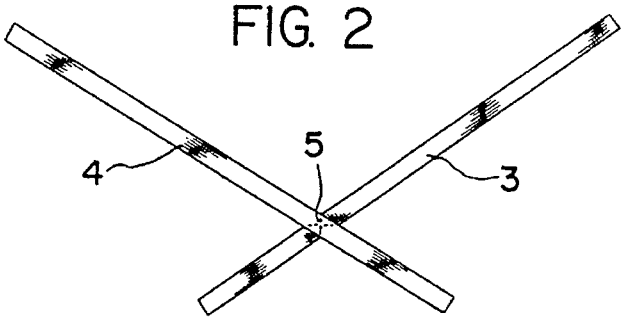
FIG. 3
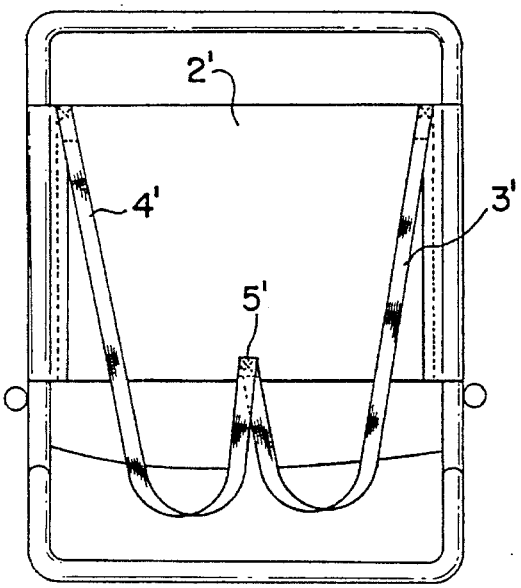
FIG. 4
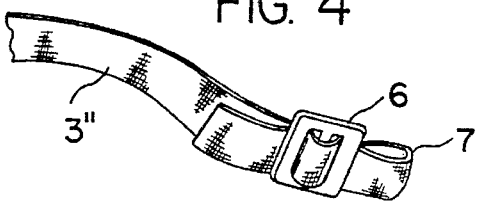
FIG. 5
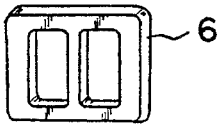

SHOULDER STRAPS FOR BEACH CHAIR

BACKGROUND OF THE INVENTION

This invention relates in general to a beach chair and, in particular to shoulder straps that are attached to a beach chair to aid in transporting the chair to the beach.

It is customary when a person spends a day at the beach that a variety of items such as towels, suntan lotion, insect repellents and blankets must be carried along. When a beach chair is added to the above list, the task becomes burdensome. The present invention has been designed to help overcome that burden by allowing the beach chair to be carried on a person's back.

DESCRIPTION OF THE PRIOR ART

In the prior art various types of shoulder straps have been proposed for beach chairs, however all of the prior art devices have suffered from various types of drawbacks. For example, prior art shoulder straps have to be adjustable to fit persons of different sizes. Also, the prior art devices required various types of straps or supports to keep the chair folded. Also, the straps of the prior art had no mechanism to keep the straps from sliding off the shoulders of the person carrying the chair.

SUMMARY OF THE INVENTION

The present invention is a pair of straps that can be attached to a variety of beach chairs and are designed so that the straps need no adjusting buckles. The straps will hang out of the way, behind the chair when the chair is used for sitting, and will fit any size person without sliding off their shoulders.

These and other objects and advantages of the present invention will be fully apparent from the following description, when taken in connection with the annexed drawings.

BRIEF DESCRIPTION OF THE DRAWINGS

FIG. 1 is a view of a standard beach chair with the straps attached.

FIG. 2 is a view of the straps as they are joined together.

FIG. 3 is view of a pair of modified straps.

FIG. 4 is a view of a modified strap that can be added to a beach chair.

FIG. 5 is a view of the buckle used with the strap of FIG. 4.

DESCRIPTION OF THE PREFERRED EMBODIMENT

In FIG. 1 there is shown a standard beach chair 1 to which the straps 3 and 4 of the present invention have been attached. As shown in FIGS. 1 and 2, the straps cross at a point 5. The crossing point of the straps is asymmetrical so that a portion of each strap on one side of the crossing point is longer than a portion of the same strap on the other side of the crossing point. This X-shaped configuration of the straps 3 and 4 keep the straps from spreading apart and slipping off the shoulders of the user. The straps are joined together at the point they cross each other. How the straps are attached to each other is not critical. For example, they could be sewn together or could be connected by a rivet or grommet.

The ends of each of the straps are attached to the material that forms the backrest of the chair. Again the strap ends can be sewn to the material or could be connected by rivets or grommets.

Because the straps cross in the manner described above no adjusting buckles are needed to accommodate different size people. The shorter portions of the straps will pass on top of the shoulders of the person using them and they will pass down the front of the shoulders, under the arms, and then back to the chair. The chair will hang slightly away from the shoulders and will rest against the small of the back or above the buttocks.

It should be noted that when the chair is folded flat and worn in the manner described above, the chair is actually upside down. That is, the bottom of the backrest is now positioned above the top of the backrest. In this upside down position the chair will remain folded flat by its own weight, since the main folding hinges 10 and 10*a* are at the uppermost location.

The embodiment shown in FIG. 3 is a slight variation on the FIG. 1 device. In FIG. 3 the straps 4' and 3' do not cross in an X-shape, instead they are attached at the bottom of the backrest fabric. The straps can be attached on top of each other or they can be attached adjacent to each other at the bottom of the backrest.

The FIG. 4 modification shows a method of attaching the straps to a chair without attaching them to the fabric of the backrest. Slide buckles 6 are used to secure the ends of the straps. The buckles allow the straps to be looped around the frame members of the chair. For example, the top of the straps could be looped around the frame member 8 and the bottom of the straps could be looped around frame member 9, as seen in FIG. 1.

Although the beach chair straps and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. Straps for attachment to a chair to enable a person to carry said chair on their shoulders in combination with a chair, said chair having a frame, a backrest attached to said frame, said backrest having at least a top portion and a bottom portion, a seat area attached to said frame allowing a person to sit on said chair, and legs also attached to said frame allowing said chair to be supported on a surface, said straps comprising, at least a pair of straps, each of said straps having a first end attached adjacent to said top portion of said backrest, and a second end attached adjacent to said bottom portion of said backrest, one of said straps crossing said other strap at a point between said first end and said second end, so that the length of said straps on one side of said crossing point is shorter than the length of said straps on the other side of said crossing point, said length of said straps on one side of said crossing point that is shorter being closer to said legs than to said top portion of said backrest, said straps are joined together at said crossing point and said crossing point being closer to said legs than to said top portion of said backrest.

2. The straps for attachment to a chair o enable a person to carry said chair on their shoulders as claimed in claim 1, wherein said straps are attached to said chair on a portion of said chair that is on an opposite side of said chair from said seat area.

3. The straps for attachment to a chair to enable a person to carry said chair on their shoulders as claimed in claim 1, wherein said backrest is a flexible panel.

4. The straps for attachment to a chair to enable a person to carry said chair on their shoulders as claimed in claim 1, wherein at least one of said ends of said straps are attached by a loop to said backrest, and:

said loop is formed adjacent to said ends of said straps, and means for attaching said ends of said straps to the remainder of said straps.

5. The straps for attachment to a chair to enable a person to carry said chair on their shoulders as claimed in claim 4, wherein said means for attaching said ends of said straps to the remainder of said straps is a buckle.

* * * * *